United States Patent [19]

Palmer

[11] Patent Number: 5,070,913

[45] Date of Patent: Dec. 10, 1991

[54] MICROPROCESSOR SHEDDING CONTROL WITH LINEAR ACTUATORS

[76] Inventor: Raymond L. Palmer, "Frogmore", Frogmore Lane, Fen End, Nr. Kenilworth, Warks CV8 1NT, England

[21] Appl. No.: 469,539

[22] PCT Filed: Jul. 24, 1989

[86] PCT No.: PCT/GB89/00840

§ 371 Date: Mar. 19, 1990

§ 102(e) Date: Mar. 19, 1990

[87] PCT Pub. No.: WO90/01081

PCT Pub. Date: Feb. 8, 1990

[30] Foreign Application Priority Data

Jul. 26, 1988 [GB] United Kingdom ..... 8817765

[51] Int. Cl.[5] ..... D03C 13/00

[52] U.S. Cl. ..... 139/319; 139/55.1; 139/59; 139/455; 139/35; 66/140 R

[58] Field of Search ..... 66/140 R, 126, 207, 66/64; 139/59, 55.1, 455, 319, 435.2, 11, 65, 35

[56] References Cited

U.S. PATENT DOCUMENTS

| | | | |
|---|---|---|---|
| 3,817,292 | 6/1974 | Doehler et al. | 139/55.1 |
| 3,853,150 | 12/1974 | Romano . | |
| 4,530,382 | 7/1985 | Schleicher | 139/319 X |
| 4,566,499 | 1/1986 | Kitagawa et al. | 139/59 |
| 4,702,286 | 10/1987 | Palau | 139/65 X |
| 4,732,179 | 3/1988 | Takegawa | 139/435.2 |
| 4,852,618 | 8/1989 | Zollinger et al. | 139/453 |

FOREIGN PATENT DOCUMENTS

| | | | |
|---|---|---|---|
| 0025978 | 9/1980 | European Pat. Off. . | |
| 2203925 | 8/1973 | Fed. Rep. of Germany | 139/455 |
| 2938388 | 4/1981 | Fed. Rep. of Germany . | |
| 3724686 | 2/1989 | Fed. Rep. of Germany | 139/455 |
| 523037 | 4/1955 | Italy | 139/59 |
| 8903443 | 4/1989 | PCT Int'l Appl. . | |
| 2057716 | 4/1981 | United Kingdom . | |
| 2186892 | 8/1987 | United Kingdom . | |

*Primary Examiner*—Andrew M. Falk

*Attorney, Agent, or Firm*—Charles A. Brown

[57] ABSTRACT

In loom control for weaving a preselected pattern design or the like, electronically controlled electric actuators (1,10) are programmed for required operation in accordance with the pattern by a computer, each actuator (1) being connected to a warp thread (W) or to more than one such thread of the shed (S) for positive operation of the threads (W) in effecting required shed formations in weaving the pattern. A flexible connection member (2) between the actuator (1) and an eye member (3) receiving a warp thread (W) may be arranged in an endless manner for positive operation of the eye member (3) in either direction. In the case of a knitting machine each actuator is connected to one or more yarn feeders and/or to the carriage or carriages of the machine for their operation in knitting the preselected pattern.

22 Claims, 2 Drawing Sheets

FIG. 5
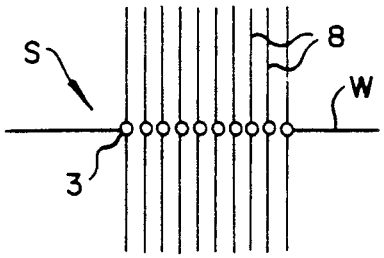
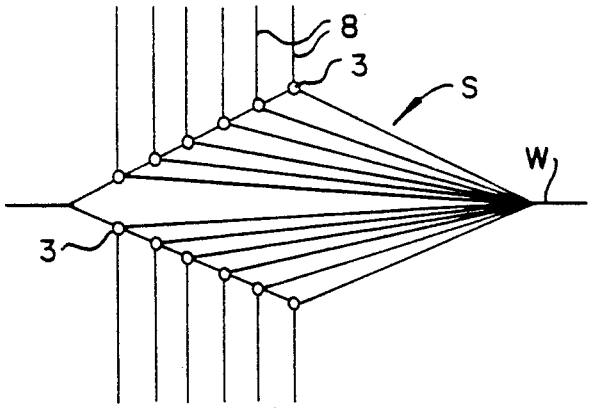
FIG. 6
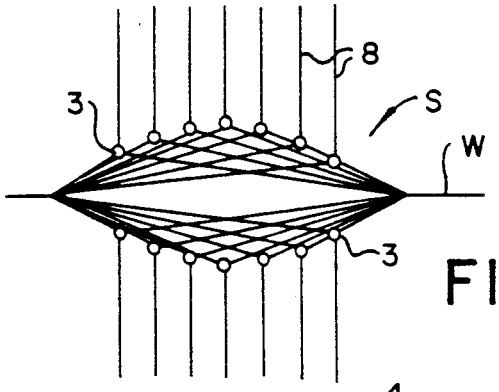
FIG. 7
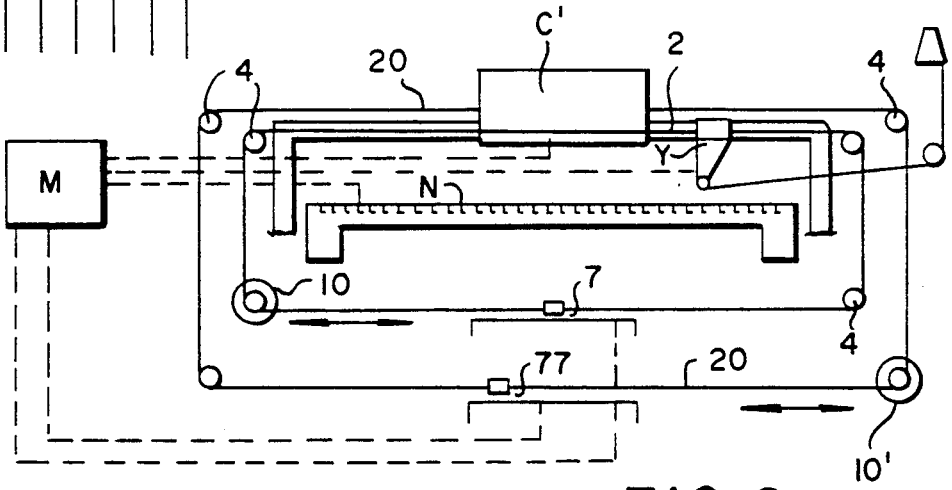
FIG. 8
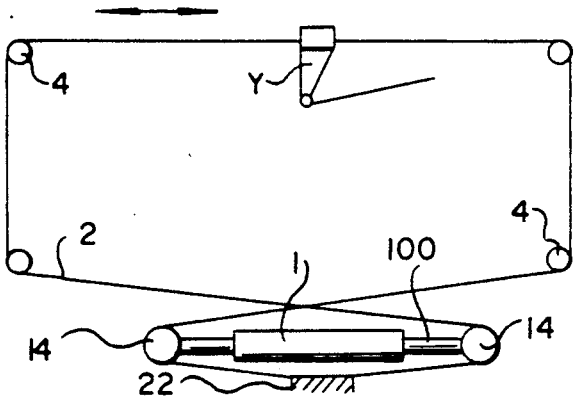
FIG. 9

MICROPROCESSOR SHEDDING CONTROL WITH LINEAR ACTUATORS

One object of this invention is to provide improved apparatus for, and method of, controlling the operation of a loom or similar weaving or textile machine in a manner hitherto achieved by Jacquard mechanism. In particular the invention provides for positive control of a loom or the like in the above manner and with a view to obtaining high speed operation but whereby the use of Jacquard mechanism is superseded and the disadvantages thereof thus avoided as will be hereinafter apparent. A further object of the invention is to provide for similar control of a knitting machine.

It has previously been proposed to provide controlled operation of loom warp thread mails or heald frames by fluid pressure operated piston and cylinder means but which has involved valve mechanism to the latter for such controlled operation.

According to the invention apparatus for controlling the operation of a loom or similar weaving machine or of a knitting machine to provide a preselected woven or knitted pattern, design or the like comprises a plurality of electronically controlled electric actuators each providing substantially linear positive actuation in either direction and each connected in use to a corresponding warp thread or to more than one of such threads of a loom shed of said threads, or to one or more of at least the yarn feeders of a knitting machine whereby said warp threads of the shed are operated or the yarn feeders are operated for the purpose of respectively weaving or knitting the preselected pattern, design or the like, the electronic control of the actuators being arranged for programmed operation by computer or like control means in accordance with said preselected pattern, design or the like to be woven or knitted.

Further in accordance with this invention there is provided the method of controlling the operation of a loom or similar weaving machine or of a knitting machine to provide a preselected woven or knitted pattern, design or the like wherein electronic control of a plurality of electric actuators each providing substantially linear positive actuation in either direction is programmed for operation by computer or like control means in accordance with the preselected pattern, design or the like to be knitted or woven and are each connected to a corresponding warp thread of a loom shed of said threads or to more than one of such threads or to one or more of at least the yarn feeders of a knitting machine whereby said warp threads of the shed are operated or the yarn feeders are operated for the purpose of respectively weaving or knitting the preselected pattern, design or the like.

Practical applications of the invention are shown in the accompanying diagrammatic drawings, in which:

FIGS. 1 and 2 respectively are schematic plan view of two arrangements of loom control operation;

FIGS. 5, 6 and 7 are schematic views of different shed formations which can be achieved in accordance with the invention;

FIG. 8 is a schematic plan view showing the application of the invention to a knitting machine, and FIG. 9 is a schematic plan view of an arrangement for increasing the stroke of a linear actuator in accordance with the invention.

Like parts are referred to by the same or similar reference numerals or letters throughout the drawings.

Figure 1:
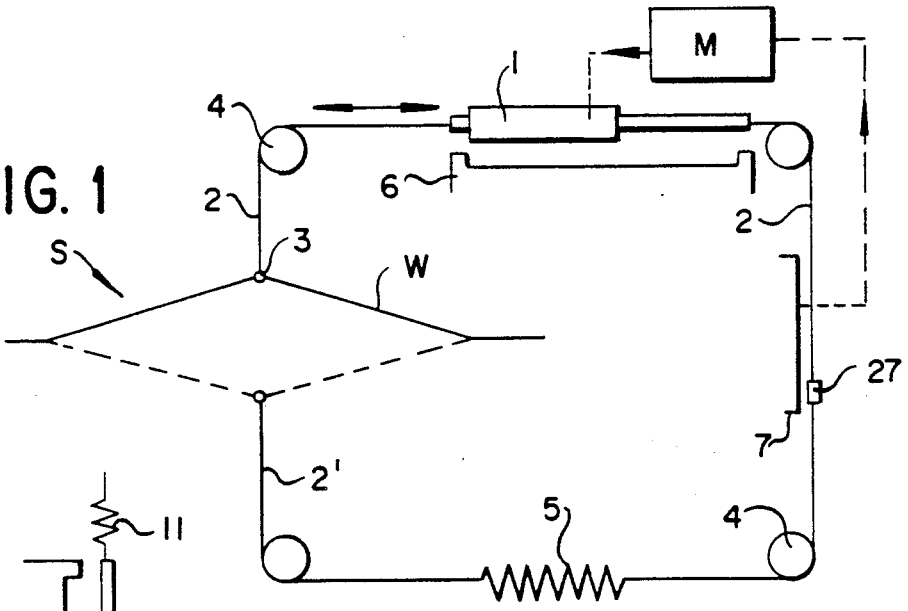

Referring to FIG. 1 and for the operation of each warp thread W of a shed S, an electronically controlled electric linear actuator .1 having positive operation in either direction is connected by a flexible elongate heddle or heald member 2 such as cord. twine, thread (e.g. nylon thread) or the like to the warp thread W by the usual eye 3 through which the warp thread passes. The cord 2 continues downwardly are 2' from the eye 3 and is returned in an endless manner to the actuator 1, the cord 2 being guided by pulleys 4 or other suitable guide means for such arrangement and back and forth operation by the actuator 1.

As the actuator 1 is operated in one direction i.e. to the right in the drawing the warp thread W is raised whilst on return operation the warp thread is pulled downwardly by the cord at 2' again with a positive action.

For required tensioning of the cord 2, a spring 5 is shown interposed in the cord and is carried by and moves back and forth with the latter. Other suitable tensioning means may be employed such as pre-tensioned cord or a spring loaded jockey wheel or the like.

Programmed electronic control and operation of a plurality of actuators 1 and corresponding warp threads W can be effected in any suitable manner and preferably directly such as from a pattern, design or the like by a computer C or microprocessor M aided image analysis system (not shown) operating in phase with the speed of cyclic operation of the loom or by punched tape or similar programming means or by any suitable computer data storage system. Software and pattern or like selection for such programmed operation is hereinafter referred to.

Whereas positive operation of each warp thread W is ensured as a precaution against failure or malfunction each actuator 1 is shown monitored by sensing means 6 which detects any departure of the actuator 1 from full linear operation in either direction. Alternatively, or preferably additionally as shown, further monitoring of the linear movement of the cord 2 is also provided in which the back and forth movement of a member such as a metal tag 27 fixed on the cord 2 is followed by a scanner 7 of sensing means for any departure from correct movement. In the event of an indication of incorrect linear movement or no such movement being given by either or both sensing means 6, 7 the relevant actuator can be replaced e.g., in a readily removable manner whilst the sensing means 6, 7 is or are preferably arranged to stop operation of the loom until the defect is remedied and so prevent or minimise the weaving of faulty cloth. Such feedback may thus form part of a closed loop system in providing a diagnostic routine.

Since the effort required to operate the cord 2 and warp thread W is small the actuator 1 can be of low power compact form and likewise the cord 2 and guide pulleys 4, can be compactly arranged. Having regard to the considerable number of warp threads W this enables a corresponding number of actuator/cord arrangements to be closely positioned in relation to the shed 5 especially by orientation about the vertical through an eye connection 3 to a warp thread W.

The path of the cord 2 and positioning of the guide pulleys 4 may vary from that shown but the arrangement is preferably such that the linear actuator 1 is disposed in the optimum horizontal position for satisfactory operation.

Although the use of a linear actuator 1 is preferred, linear actuation may be obtained from a rotary motor such as a stepping motor or servomotor driving a crank arm for back and forth movement, the free end of which is anchored to the cord 2 and is reciprocated by the motor through an arc which has the effect of imparting required linear movement to the cord. In the case of a reversible stepping motor or other suitable motor it may drive a drum or similar member about which the cord 2 is wound in a capstan fashion, the forward and reverse drive of the drum imparting back and forth linear movement to the cord 2.

Figure 2:
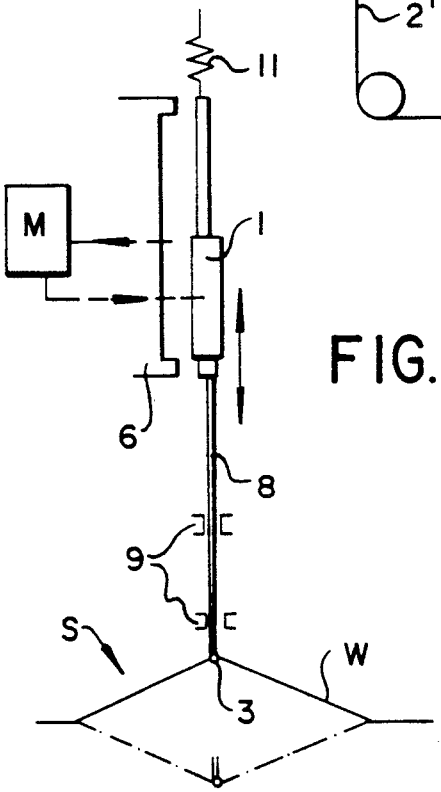

If desired the actuators and cord assembly may be arranged to operate a warp hook or heddle for positive two-way reciprocation or, in an alternative embodiment of the invention shown in FIG. 2, an actuator 1 may be directly connected to the warp hook 8 which carries an eye 3 at its lower end receiving the corresponding warp thread W at the shed S. The hook 8 is guided at 9 for vertical reciprocating axial movement. Having regard to its vertical position the actuator 1 may be spring loaded at 11 to assist return movement for satisfactory operation whilst the correct extent of operation of the actuator 1 is monitored at 6. Reciprocation of the hook 8 may be also monitored or alternatively monitored.

Figure 3:
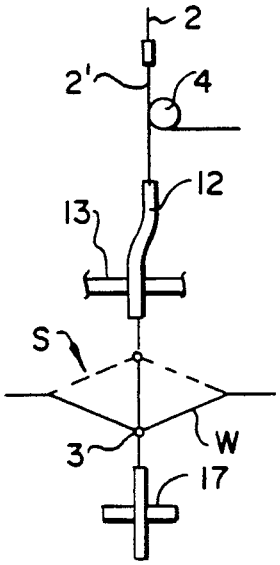
FIG. 3 is a schematic plan view of a detail development of the inventions.

Here again the actuator arrangement is of compact form to suit the close spacing together of warp hooks 8 and the actuators 1 only require low power operation. If necessary for suitable disposition of the actuators 1 they may actuate the hooks 8 through linkage such as bell crank mechanism or by Bowden cable or similar connection as at 12 in FIG. 3 and which is applicable to the arrangement of FIG. 1 (as shown) or direct Bowden cable connection may be effected between the actuator 1 and a heddle 8. The Bowden cable 12 is shown located through a comber board 13. Guided rod connection (e.g. in nylon guides) may be employed or connection by rigid or flexible carbon fibre rods or the like. Sensing means is shown provided at 17 for detecting incorrect movement or non-operation of the heddle 8.

As will be clearly evident from the foregoing shedding of the warp threads W can be effected by the actuators 1 and cords 2 (FIG. 1) or the actuators 1 (FIG. 2) in a simple, inexpensive and effective manner and with a positive action in weaving an endless variety of patterns, designs or the like.

As well as low electrical power consumption it is believed that high speed operation of the shedding motion should be obtainable e.g. of the order of 1200 picks per minute of weft thread operation.

Figure 4:
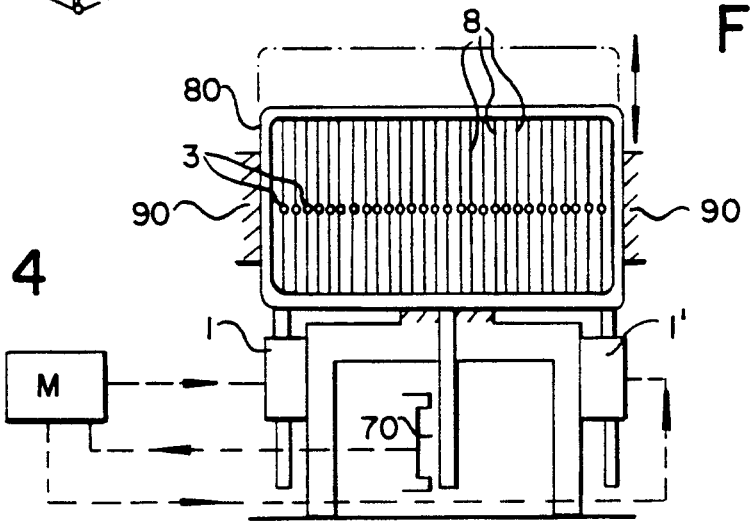
FIG. 4 is a schematic elevational view of an arrangement of the invention applied to a heddle frame operation.

Whereas individual actuation of each warp thread W is preferred, a number of warp threads, especially a considerable number of them, may be operated together by one or a pair of actuators. Thus whereas a heddle frame 80 carrying the heddles 8 may be operated from a single actuator by guided cord operation in a similar manner to that shown in FIG. 1, or by other suitable connection or mechanical system, direct operation may be effected such as by master and slave actuators 1, 1' shown in FIG. 4, the heddle frame 80 being guided at 9. Operation of the frame 80 is shown sensed at 70.

The actuator arrangements according to this invention and loom control effected by them enable Jacquard mechanism to be dispensed with resulting in considerable reduction in initial installation expenditure and subsequent running costs. Thus Jacquard mechanism entails the use of substantial crank or cam driving gear for raising and lowering the hook carrying griff against spring loading of the order of 1 Kg per warp thread all of which requires a considerable amount of power to operate the driving gear as well as substantial support structure for the latter.

A further disadvantage of Jacquard mechanism is that despite electronic or electromagnetic selection of warp hooks for operation, malfunction of a hook or hooks can occur and which usually cannot be checked until resulting faults appear in the woven fabric. In contrast the positive operation of the warp threads by the actuator arrangements of the present invention and the monitoring which can be readily effected virtually eliminate faulty operation.

Further practical advantages and applications of the invention will be apparent from the following.

Thus owing to the computerised operation of the actuators it can be readily arranged for all the warp threads W to be brought to a "centre or closed shed" position FIG. 5 i.e. in the same plane from the operative open shed condition. This enables all the warp threads to be kept under substantially the same reduced tension when the loom is not in operation over a period of time.

Individual actuation of each warp thread (or in some cases group operation of a number of warp threads) greatly facilitates setting up of a loom with fresh warp threads since the eye or eyes 3, can be selectively brought to a convenient and readily ascertained position for threading of warp thread through the or each eye. Sequential setting up procedure can be provided by the computer C or microprocessor M from model pattern formats.

Actuator arrangements according to this invention are capable of effective application where oblique or parabolic shedding is required i.e., by appropriate control of the actuators 1 as respectively indicated in FIGS. 6 and 7 so that required warp thread operation is obtained.

The computer C or microprocessor M determines the geometry of the shed functions i.e. its size and shape. This information is stored in a memory or can be established using positioning devices such as potentiometers or switches as appropriate.

The speed of how the shed size and shape is operated is also programmable as per the computer C or microprocessor M or by a suitable electrical speed setting device.

Pattern and/or obliqueness data can be entered into the computer C through either its keyboard or from a host computer C by means of eprom, disc, ram card, serial link, parallel link or by network as appropriate or by any other memory data transfer device.

The operation of the apparatus can be checked directly by the computer or by the synchronisation of an external source. Thus the computer C using the control data is able to advise and report on the management and performance of the whole apparatus including predicting the possible failure rates prior to their occurrence thus providing a schedule of preventative maintenance routines.

The use of appropriate software enables the computer C or microprocessor M to hold in its memory the optimum operating conditions for each of the woven cloths or knitted patterns (as later referred to). It therefore not only undertakes the controlling aspects of the sequence of operation of the loom or knitting machine in per-forming its process operations but also the management of them and the reporting of both the completed work as well as any faults or failures which may have occurred which information can be provided by suitable display means. The software system for the purpose of this invention can have the necessary architecture to fulfill these requirements together with fault diagnostics either for stand alone single purpose machines or for fully integrated machines working from a host computer.

As well as the foregoing the software enables the computer to provide setting up procedures and operation from any of a wide range of patterns or the like stored in the computer memory such that by simple classification and coding routines any pattern can be selected and called up instantly for immediate use.

When it becomes necessary to effect seaming or joining of woven or knitted material in a suitable weaving machine the software further enables the splice point to be varied continuously using a spaced randoming algorithm suitably weighted to avoid bunching and to maximise and optimise the strength of the joined section automatically and in a manner which has not been hitherto readily available.

Actuator arrangements according to this invention are also applicable to the operation of knitting machines whether of the flat bed or rotary type where sequential actuations are entailed in placing the carriage, yarn feeders and the intarsia yarn feeders in their respective positions relative to the pattern being knitted.

The present operating procedure of such machines is to actuate the carriage along the needle bed to carry out the knitting pattern. From the bridge of the carriage or from other structure the yarn feeders are coupled and de-coupled as required using solenoid actuated pawls or dogs to position the wool or yarn within the pattern knitting widths. Whereas positive operation of the pawls ensures that the knitting pattern has been performed correctly, failure to engage a pawl usually cannot be checked or detected until the resulting fault appears in the pattern of the knitted material, i.e. automatic operation unattended by a machine operator is precluded.

The present actuator arrangement provides for independent actuation of the carriage, the yarn feeders and the intarsia yarn feeders so that their respective travelling movements and operations are not the results of combined mechanical actuations but that of independent actuation precisely organised and controlled from the computer C based knitting pattern with all the advantages of effective operation already referred to.

In the example shown in FIG. 8 each yarn feeder of a flat bed machine of which one is shown at Y is operated by cord 2 guided by pulleys 4 or other guide means from an actuator shown in the form of a rotary stepping motor or servomotor 10 but which may be a linear actuator in either case providing positive back and forth linear operation of the yarn feeder Y relative to the needle bed N. In a similar manner the carriage C' is shown operated relative to the needle bed by guided cord 20 from an actuator motor 10'.

In some cases directly connected actuator operation of the yarn feeder and/or carriage may be employed as appropriate whilst one actuator may operate more than one yarn feeder or a multiple yarn feeder. Actuator operation of more than one carriage can be readily provided.

Cord movement is shown sensed at 7, 77 for monitoring the movement of the yarn feeders Y and carriage C' in order to immediately detect any faulty operation or non-operation.

Generally speaking servomotor actuation 10 is suitable for long bed machines where greater extents of linear movements of the yarn feeders Y and carriage C' or carriages are entailed whereas linear actuators 1 would usually be sufficient for short bed machines. However, if necessary the stroke of a linear actuator can be, in effect, increased in either direction as shown in FIG. 9 where the cord 2 is fixedly anchored at 22 and passes round pulleys 14 one at each end of the linearly movable member 100 of the actuator 1 prior to passage about guide pulleys 4 to a yarn feeder Y, carriage or other member or members to be actuated (such as a heddle or heddles in the case of a loom) As will be appreciated the extent of effective linear movement of the cord 2 is twice that of the movable member 100 of the actuator 1 in either direction.

It is to be understood that the invention herein defined and described includes the method of loom, knitting machine or like control provided as well as the means for effecting such control.

I claim:

1. Apparatus for controlling movement of yarn carrying members in a fabric forming machine to form fabric of a selected pattern, said apparatus comprising:

a plurality of electronically controlled electric actuators each of which has means for connecting it to at least one of said members and actuable to move said at least one member in a substantially linear movement between first and second extreme positions; and microprocessor means having a memory for storing data representing selected operating parameters for producing a preselected textile pattern, and data transfer means for inputting said data into said memory, wherein said microprocessor means is operable to control actuation of said actuators in a preselectable manner in dependence on said data to cause each said actuator to selectively move said at least one member into a selected one of said first and second extreme positions and a preselectable third position intermediate said first and second positions.

2. Apparatus according to claim 1 wherein said first and second extreme positions are variable in response to said selected operating parameters for producing a preselected textile pattern, said first and second extreme positions being controlled by said microprocessor means in response to stored data representing said selected operating parameters.

3. Apparatus according to claim 1 wherein monitoring means are provided, said monitoring means including sensor means for sensing the position of each said member between said first and second extreme positions in response to actuation of the associated actuator by said microprocessor means, said monitoring means being operable to provide a signal indicative of any deviation of said movement from a normal operating movement.

4. Apparatus according to claim 3 wherein said microprocessor means is operable to stop operation of said fabric forming machine in response to the signal indicating said deviation.

5. Apparatus according to claim 1 wherein at least one of said actuators is connected in use for the operation of a carriage of a knitting machine.

6. Apparatus for controlling movement of yarn carrying members in a fabric forming machine to form fabric of a selected pattern, said apparatus comprising:

a plurality of electronically controlled electric actuators each of which has means for connecting it to at least one of said members and actuable to move said at least one member in a substantially linear movement between first and second extreme positions; and microprocessor means having a memory for storing data representing selected operating parameters for producing a preselected fabric pattern, and data transfer means for inputting said data into said memory;

wherein said microprocessor means is operable to control actuation of said actuators in a preselectable manner in dependence on said data to cause each said actuator to selectively move said at least one member into a selected one of said first and second extreme positions;

wherein said means for connecting each said actuator to said at least one member is flexible connection means; and wherein said first and second extreme positions are variable in response to said selected operating parameters for producing a preselected textile pattern, said first and second extreme positions being controlled by said microprocessor means in response to stored data representing said selected operating parameters.

7. Apparatus according to claim 6 wherein said flexible connection means comprise an endless mechanical loop.

8. Apparatus according to claim 6 wherein the flexible connection means comprises a Bowden cable means.

9. Apparatus according to claim 6 wherein a drum member is provided, said flexible connection means is wound around said drum member and said actuator is operable to drive said drum member rotatably whereby the flexible connection means is moved along its own path in a selected one of a forward and a reverse direction.

10. Apparatus according to claim 6 wherein fixed anchor means are provided to which said flexible connection means is fixedly anchored and wherein guide means are provided at least one end of a movable member of said linear electric actuator whereby the extent of linear movement of said flexible connection means is twice that of said movable member of said actuator.

11. Apparatus according to claim 6 wherein monitoring means are provided, said monitoring means including sensor means for sensing the position of each said member between said first and second extreme positions in response to actuation of the associated actuator by said microprocessor means, said monitoring means being operable to provide a signal indicative of any deviation as said movement from a normal operating movement.

12. Apparatus according to claim 11 wherein said microprocessor means is operable to stop operation of said fabric forming machine in response to the signal indicating said deviation.

13. Apparatus according to claim 6 wherein at least one of said actuators is connected in use for the operation of a carriage of a knitting machine.

14. A method of controlling movement of yarn moving members in a fabric forming machine to form fabric of a selected pattern, said method comprising:

providing a plurality of electronically controlled electric actuators each of which is connected to at least one of said members and actuable to move said at least one member in a substantially linear movement between first and second extreme positions; and storing data representing selected operating parameters for producing a preselected fabric pattern;

controlling actuation of said actuators in a preselectable manner in dependence on said data to cause each said actuator to selectively move said at least one member into a preselected one of said first and second extreme positions and into a preselectable third position intermediate said first and second positions.

15. A method according to claim 14 including a step of controlling locations of said first and second extreme positions in response to said stored data representing selected operating parameters for producing a preselected fabric pattern.

16. A method according to claim 14 including a step of monitoring movement of each said member between said first and second extreme positions in response to actuation of an associated actuator to produce a signal indicating deviation of said movement of each said member from a normal operating movement.

17. A method according to claim 16 and including a step of stopping movement of said yarn carrying members in the fabric forming machine in response to generation of said signal indicating deviation of said movement from a normal operating movement.

18. A method of controlling movement of yarn moving members in a fabric forming machine to form fabric of a selected pattern, the method comprising:

providing of electronically controlled electric actuators each of which is connected to at least one of said members and actuable to move said at least one member in a substantially linear movement between first and second extreme positions;

storing data representing selected operating parameters for producing a preselected fabric pattern;

controlling actuation of said actuators in a preselectable manner in dependence on said data to cause each said actuator to selectively move said at least one member into a preselected one of said first and second extreme positions;

and including the steps of connecting each actuator to said at least one member of flexible connection means, said actuator being operable to move said flexible connection means along a path in a forward or reverse direction to move said member between said first and second extreme positions; and controlling locations of said first and second extreme positions in response to said stored data representing selected operating parameters for producing a preselected fabric pattern.

19. A method according to claim 18 wherein said step of connecting said actuator to said at least one member by means of flexible connection means include connecting an endless mechanical loop including said flexible connection means.

20. A method according to claim 18 including the further step of tensioning said flexible connection means.

21. A method according to claim 19 including the further step of tensioning said flexible connection means.

22. A method according to claim 18 including a step of monitoring movement of each said member between said first and second extreme positions in response to actuation of an associated actuator to produce a signal indicating deviation of said movement of each said member from a normal operating movement.

* * * * *